US006807982B1

(12) United States Patent
Ames

(10) Patent No.: US 6,807,982 B1
(45) Date of Patent: Oct. 26, 2004

(54) HOSE TUB

(76) Inventor: Larry Ames, P.O. Box 3253, New Bern, NC (US) 28564

( * ) Notice: Subject to any disclaimer, the term of this patent is extended or adjusted under 35 U.S.C. 154(b) by 0 days.

(21) Appl. No.: 10/632,269

(22) Filed: Jul. 31, 2003

(51) Int. Cl.[7] ..... B65H 75/36
(52) U.S. Cl. ..... 137/355.28; 137/355.27
(58) Field of Search ..... 137/355.16, 355.26, 137/355.27, 355.28

(56) References Cited

U.S. PATENT DOCUMENTS

| | | | | | |
|---|---|---|---|---|---|
| 1,942,388 | A | | 1/1934 | Ash | |
| 2,300,243 | A | | 10/1942 | Zierden | |
| 2,334,141 | A | * | 11/1943 | Zierden | 137/355.28 |
| 2,339,901 | A | * | 1/1944 | Zierden | 137/355.28 |
| 2,590,963 | A | * | 4/1952 | Hannay | 137/355.27 |
| 2,871,057 | A | | 1/1959 | Bernyk | |
| 4,588,083 | A | | 5/1986 | Hunt | |
| 4,649,954 | A | | 3/1987 | Dunwoody | |
| 4,757,838 | A | * | 7/1988 | McGullion | 137/355.27 |
| 5,011,034 | A | | 4/1991 | Abel | |
| 5,402,814 | A | | 4/1995 | Odom | |
| 5,915,641 | A | | 6/1999 | Barberg | |
| 5,957,400 | A | * | 9/1999 | Brannen | 137/355.27 |
| 5,988,207 | A | | 11/1999 | Knownacki et al. | |
| 6,561,449 | B2 | * | 5/2003 | Lindermeir et al. | 137/355.27 |

* cited by examiner

*Primary Examiner*—Kevin Lee
(74) *Attorney, Agent, or Firm*—MacCord Mason PLLC

(57) ABSTRACT

The present invention is directed to a hose storage apparatus for improving the ease of storage and transport of a hose. Generally, the present invention is a hose storage apparatus made up of a receptacle including a cylindrical outer wall having a first diameter and a first lower edge and, a cylindrical inner wall having a second diameter smaller than the first and a second lower edge. The walls have a common longitudinal axis, and a bottom wall extending across the inner and outer walls' lower edges. The space between the inner and outer walls forms an annular hose compartment. A general-purpose storage compartment is located within the inner wall. A lid with a handle is provided to protect any contents stored within the general-purpose storage compartment. A mounting post axially aligned with the walls' common longitudinal axis supports the weight of the receptacle. The mounting post includes a lower section with a water inlet connector and an axially aligned upper section rotatably mounted on the lower section. The upper section includes a water outlet connection that extends into the annular hose compartment.

20 Claims, 3 Drawing Sheets

HOSE TUB

BACKGROUND OF THE INVENTION

1. Field of the Invention

The present invention is directed to an apparatus for storing a garden hose. In particular, the present invention is directed to a hose tub that simplifies the collection, storage and transport of a garden hose as well as provides for general-purpose storage of hose accessories and lawn tools, etc.

2. Description of the Prior Art

Apparatus used to store garden hoses are well known in the art. One common type is the wheeled hose reel. One example of this type hose reel is U.S. Pat. No. 4,649,954 to Dunwoody. While these types of hose reel provide convenient transport of garden hoses, they do not protect all portions of the hose from prolonged exposure to sunlight and the elements.

Another type of storage and transport apparatus is a wheeled hose basket like that disclosed in U.S. Pat. No. 2,871,057 to Bernk. Bernk discloses a receptacle having an internal frame used to organize coils of hose as a user lays hose coils into the receptacle. Bernk does not provide for general-purpose storage of hose accessories and lawn tools.

Yet, another type of hose storage apparatus is an upright rotatable container used to collect and store a garden hose. Typical prior art apparatus of this type are disclosed in U.S. Pat. Nos. 5,988,207, 2,300,243 and 1,942,388. These patents all disclose containers rotatably mounted on top of a stationary base plate or stand. The container is rotated to coil a hose for storage, if a user carefully hand guides the hose against the wall of the receptacle. However, until the present invention, this type of hose storage apparatus lacked wheeled support for easy transport from one location to another.

None of the prior art located discloses an apparatus that can be used to guide coiling of a hose into an upright annular storage container. Moreover, none of the prior art discloses such a hose storage apparatus while also providing general-purpose storage for hose accessories and lawn tools. Therefore, there remains a need for a hose storage apparatus that includes all these features.

SUMMARY OF THE INVENTION

The present invention is directed to a hose storage apparatus for improving the ease of storage and transport of a garden hose. The invention relates especially to a hose storage apparatus having a hose guide to aid the coiling of a garden hose into a protective compartment that is easily transported.

Generally, the present invention is a hose storage apparatus comprising a receptacle including a cylindrical outer wall having a first diameter and a first lower edge, and a cylindrical inner wall having a second diameter smaller than the first and a second lower edge. The walls have a common longitudinal axis, and a bottom wall extending across the inner and outer walls' lower edges to form an annular hose compartment between its inner and outer walls. A general-purpose storage compartment is located within the inner wall. A lid with a handle is provided to protect any contents stored within the general-purpose storage compartment.

A mounting post axially aligned with the walls' common longitudinal axis supports the weight of the receptacle. The mounting post includes a lower section with a water inlet connector and an axially aligned upper section rotatably mounted on the lower section. The upper section includes a water outlet connection that extends into the annular hose compartment.

In a preferred embodiment, a hose guide is mounted above the hose compartment to guide a hose into and out of the annular hose compartment. The hose guide can have an end that might be hook shaped, circular or a relatively short tube having an inside diameter greater than the outside diameter of a hose being coiled. If the hose guide is tubular, the tube can be pivotally attached to a guide arm such that the guide is free to pivot as a function of the amount of hose within the annular hose compartment. When feeding a hose into the receptacle by way of the hose guide, frictional forces between the hose and the receptacle's outer wall causes the receptacle to rotate, coiling the hose into the annular hose compartment.

The hose tub can also include a wheeled receptacle support having a base on which the mounting post is attached to bear the weight of the receptacle. A pair of wheels is rotatably connected to an axle, which in turn is rotatably connected to the wheeled receptacle support. The wheeled receptacle support has a generally vertical position when the base is on a horizontal surface and a transport position whereby the receptacle is tilted for wheeled transport from one location to another.

In operation, a user uses the hose guide to pass the connection end of a garden hose into the hose tub's annular hose compartment. Next, the user attaches the hose connection end to the water outlet connector extending into the annular hose compartment. The user then proceeds to load the hose into the hose compartment by feeding the hose into the hose compartment through the hose guide. Frictional forces between the inwardly directed hose and the receptacle's outer wall forces the receptacle to rotate, coiling the hose into the annular hose compartment.

Next, the user readies the hose tub for transport by tilting the wheeled receptacle, which lifts the support base from the ground, resting the entire weight of the hose tub apparatus on its wheeled receptacle support. The hose tub can then be pushed or pulled by the wheeled support's handle to a location near a spigot. A short piece of connecting hose is then used to connect the hose tub's water inlet connector to the spigot. The user can then pull a needed length of hose through the hose guide and turn on the spigot to water a lawn or garden. After the watering activity is completed, the spigot is turned off and the extracted length of hose is returned to the hose compartment. The short length of connection hose is disconnected and the hose tub is ready to wheel to another location. These and other aspects of the present invention will become apparent to those skilled in the art after a reading of the following description of the preferred embodiment.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
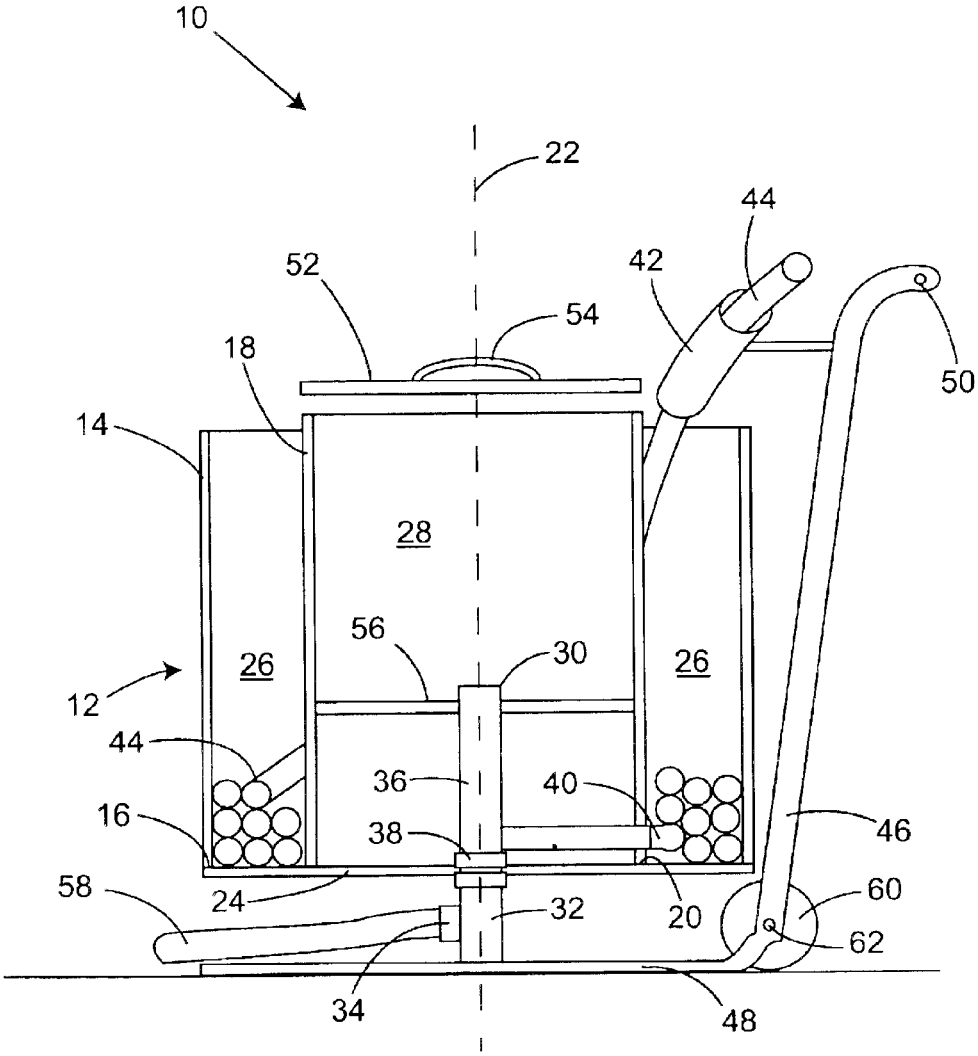
FIG. 1 is a cross-sectional view of the hose tub resting upright on its base.

Referring to the drawings and first to FIG. 1, a garden hose storage apparatus 10 comprises a hose receptacle 12. Hose receptacle 12 includes a cylinder outer wall 14 having a first diameter and a first lower edge 16. Receptacle 12 further includes a cylinder inner wall 18 having a second diameter and a second lower edge 20. Cylinder walls 14 and 18 share a common longitudinal axis 22 and a bottom wall 24 that extends across lower edges 16 and 20 to form an annular hose compartment 26 between walls 14 and 18. A general-purpose storage compartment 28 is located within inner wall 18.

Garden hose storage apparatus 10 further comprises a mounting post 30, having a lower section 32 with a water inlet connector 34 and an axially aligned upper section 36 rotatably mounted on lower section 32. In the preferred embodiment, sections 32 and 36 are coupled together with a rotatable watertight coupling 38. Upper section 36 further includes a water outlet connection 40.

A hose guide 42 is mounted above hose compartment 26 to guide a hose 44 to and from hose compartment 26. Preferably, hose guide 42 is a tube having an inside diameter larger than the outside diameter of hose 44. It is also preferred that hose guide 42 is positioned such that feeding hose 44 inwardly through guide 42 rotates receptacle 12, coiling hose 44 into annular hose compartment 26.

In the preferred embodiment, apparatus 10 includes a wheeled receptacle support 46 having a base 48. Wheeled receptacle support 46 has a first position whereby hose receptacle 12 is in generally vertical position when base 48 is on a horizontal surface and a second position whereby receptacle 12 is tilted for wheeled transport from one location to another. Preferably, wheeled receptacle support 46 slopes upwardly and slightly away from receptacle 12 ending with a handle 50.

The preferred embodiment also includes a lid 52 for protecting any items stored with storage compartment 28. Preferably lid 52 includes a handle 54. Storage compartment 28 also includes a divider wall 56 adjacent to the upward extent of mounting post 30 for protecting water outlet connection 40.

In operation, the user attaches a hose's connection end to water outlet connector 40 extending into annular hose compartment 26. The user then proceeds to load hose 44 into hose compartment 26 by feeding hose 44 through hose guide 44. Frictional forces between inwardly directed hose 44 and outer wall 14 forces receptacle 12 to rotate, coiling hose 44 into annular hose compartment 26.

Figure 2:
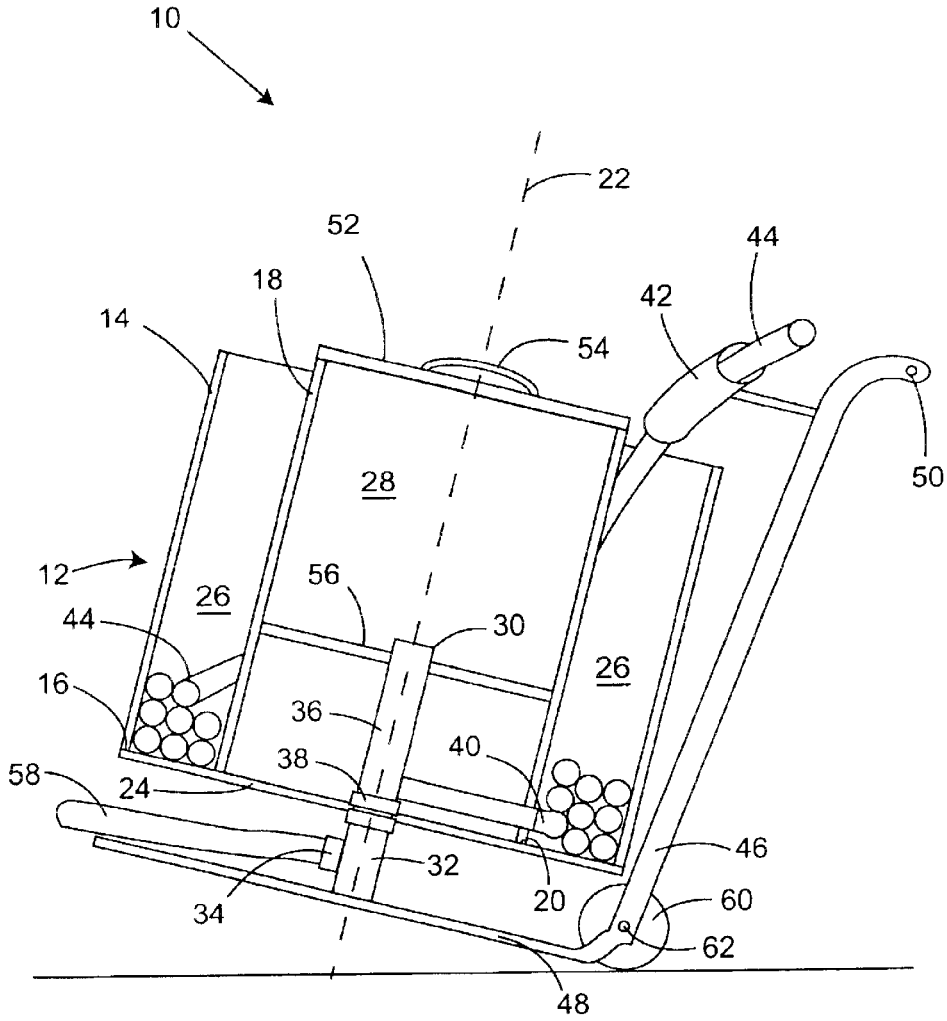
FIG. 2 is a cross-sectional view of the hose tub tilted for transport.

Next as shown in FIG. 2, hose tub 10 is moved from one location to another by first tilting wheeled receptacle support 46 which lifts support base 48 from the ground, resting the entire weight of hose tub 10 on its wheeled receptacle support 46. Hose tub 10 can then be pushed or pulled by wheeled support handle 50 to a location near a spigot. A short piece of connecting hose 58 is then used to connect water inlet connector 34 to the spigot. The user can then pull a needed length of hose 44 past hose guide 42 and turn on the spigot to water a lawn or garden. After the watering activity is completed, the spigot is turned off and the extracted length of hose 44 is returned to hose compartment 26. Connection hose 58 is disconnected from the spigot and hose tub 10 is ready to wheel to another location.

Figure 3:
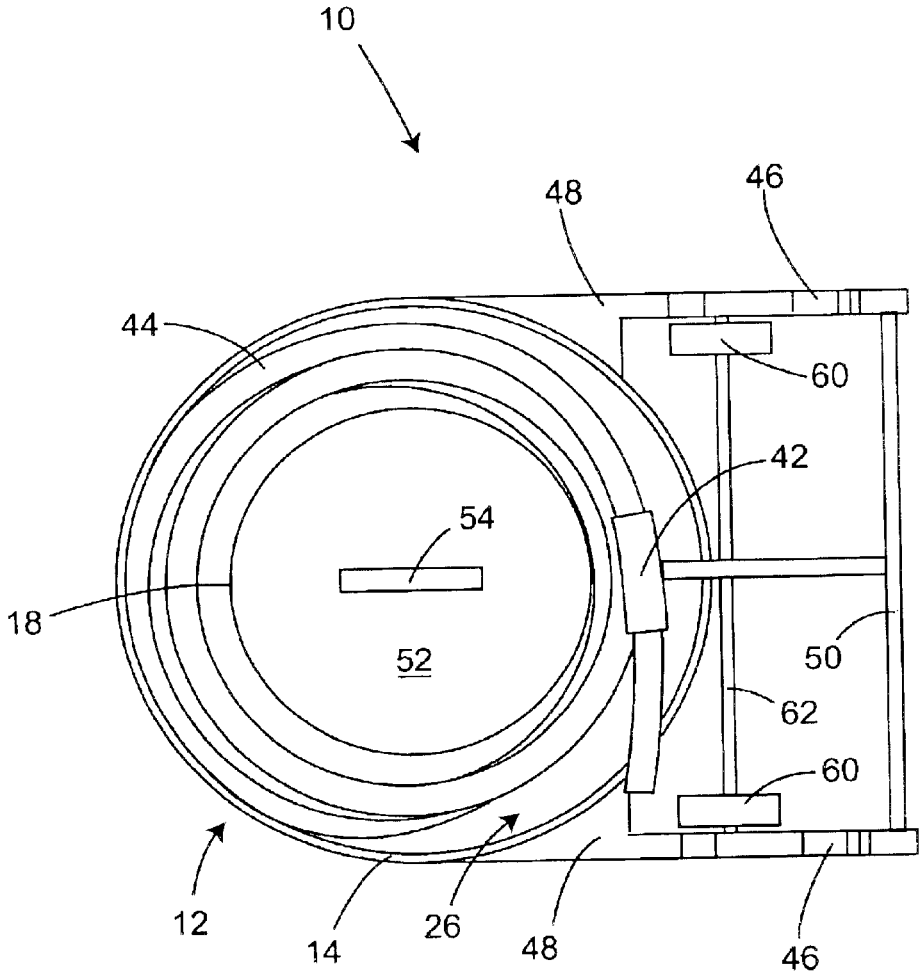
FIG. 3 is a top view of the hose tub.

FIG. 3 shows a top view of hose tub 10. Wheels 60 are rotatably connected to an axle 62 which in turn is rotatably connected to wheeled receptacle support 46.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A garden hose storage apparatus comprising:

a) a hose receptacle including a cylindrical outer wall having a first diameter and a first lower edge, a cylindrical inner wall having a second diameter smaller than said first diameter and a second lower edge, said walls having a common longitudinal axis, and a bottom wall extending across the lower edges of said inner and outer walls to form an annular hose compartment between said walls and a storage compartment within said inner wall;

b) a mounting post having a lower section with a water inlet connector and an axially aligned upper section rotatably mounted on said lower section, said upper section including a water outlet connection; and c) a hose guide mounted above said hose compartment, whereby the feeding of a hose inwardly through the guide causes rotation of said receptacle, coiling said hose into said annular hose compartment.

2. The garden hose storage apparatus of claim 1, wherein said receptacle has a base to support said hose receptacle in a generally vertical position when said base is on a level surface.

3. The garden hose storage apparatus of claim 2, further including a wheeled receptacle support attached to said base, said support having a first position whereby said hose receptacle is in a generally vertical position when said base is on a horizontal surface and a transport position whereby said receptacle is tilted for wheeled transport from one location to another.

4. The garden hose storage apparatus of claim 3, wherein said wheeled receptacle support includes a handle.

5. The garden hose storage apparatus of claim 1, further including a lid for covering said storage compartment within said inner wall.

6. The garden hose storage apparatus of claim 1, wherein said upper and lower post sections are coupled with a watertight rotatable coupling.

7. The garden hose storage apparatus of claim 1, wherein said hose guide has an end positioned above said annular hose compartment.

8. The garden hose storage apparatus of claim 1, wherein said inner wall storage compartment includes a divider wall adjacent to the upward extent of said mounting post for protecting said water outlet connection.

9. The garden hose storage apparatus of claim 1, further including a spigot connection hose connected to said water inlet connection.

10. A garden hose storage apparatus comprising:

a) a hose receptacle including a cylindrical outer wall having a first diameter and a first lower edge, a cylindrical inner wall having a second diameter smaller than said first diameter and a second lower edge, said walls having a common longitudinal axis, and a bottom wall extending across the lower edges of said inner and outer walls to form an annular hose compartment between said walls and a storage compartment within said inner wall;

b) a mounting post having a lower section with a water inlet connector and an axially aligned upper section rotatably mounted on said lower section, said upper section including a water outlet connection; and c) a wheeled receptacle support having a base, said support having a first position whereby said hose receptacle is in a generally vertical position when said base is on a horizontal surface and a transport position whereby said receptacle is tilted for wheeled transport from one location to another.

11. The garden hose storage apparatus of claim 10, wherein a hose guide is mounted above said hose compartment, whereby the feeding of a hose inwardly through said hose guide causes rotation of said receptacle, coiling said hose into said annular hose compartment.

12. The garden hose storage apparatus of claim 11, wherein said hose guide has an end positioned over the annular hose compartment.

13. The garden hose storage apparatus of claim 10, wherein said wheeled receptacle support includes a handle.

14. The garden hose storage apparatus of claim 10, further including a lid for covering said storage compartment within said inner wall.

15. The garden hose storage apparatus of claim 10, wherein said upper and lower post sections are coupled with a watertight rotatable coupling.

16. A garden hose storage apparatus comprising:

a) a hose receptacle including a cylindrical outer wall having a first diameter and a first lower edge, a cylindrical inner wall having a second diameter smaller than said first diameter and a second lower edge, said walls having a common longitudinal axis, and a bottom wall extending across the lower edges of said inner and outer walls to form an annular hose compartment between said walls and a storage compartment within said inner wall;

b) a mounting post having a lower section with a water inlet connector and an axially aligned upper section rotatably mounted on said lower section, said upper section including a water outlet connection;

c) a hose guide mounted above said hose compartment, whereby the feeding of a hose inwardly through the guide causes rotation of said receptacle coiling said hose into said annular hose compartment; and d) a wheeled receptacle support having a base said support having a first position whereby said hose receptacle is in an upright position when said base is on a level surface and a transport position whereby said receptacle is tiltable for wheeled transport from one location to another.

17. The garden hose storage apparatus of claim 16, wherein said hose guide has an end positioned over said annular hose compartment.

18. The garden hose storage apparatus of claim 16, wherein said wheeled receptacle support includes a handle.

19. The garden hose storage apparatus of claim 16, wherein said upper and lower post sections are coupled with a watertight rotatable coupling.

20. The garden hose storage apparatus of claim 16, further including a lid for covering said storage compartment within said inner wall.

* * * * *